US005416924A

United States Patent [19]

Sims

[11] Patent Number: 5,416,924

[45] Date of Patent: May 23, 1995

[54] FLEXIBLE PROTECTIVE PADDING

[76] Inventor: Leon Sims, 2606 N. 88th St., Omaha, Nebr. 68134

[21] Appl. No.: 762,624

[22] Filed: Sep. 19, 1991

[51] Int. Cl.[6] ..... A41D 13/00

[52] U.S. Cl. ..... 2/24

[58] Field of Search ..... 2/22, 24, 16, 2, 267

[56] References Cited

U.S. PATENT DOCUMENTS

| | | | |
|---|---|---|---|
| 3,761,960 | 10/1973 | Woodcock | 2/22 |
| 4,151,614 | 5/1979 | Rhee | 2/24 |
| 4,354,280 | 10/1982 | Hayes | 2/24 X |
| 4,627,108 | 12/1986 | Järvinen | 2/24 X |
| 4,685,153 | 8/1987 | Sims | 2/24 |
| 4,868,926 | 9/1989 | Lowson | 2/22 |

FOREIGN PATENT DOCUMENTS

| | | | |
|---|---|---|---|
| 2085708 | 5/1982 | United Kingdom | 2/24 |

*Primary Examiner*—Clifford D. Crowder

*Assistant Examiner*—Paul C. Lewis

*Attorney, Agent, or Firm*—Zarley, Mckee, Thomte, Voorhees & Sease; Mark D. Frederiksen

[57] ABSTRACT

A protective pad includes a sheet of generally rigid malleable material having a plurality of spaced apart slots formed along at least a pair of opposing side edges, to form wing portions between the slots. The sheet is bent from end to end and from side to side to conform to a portion of the body. The side edges of the sheet are shortened by overlapping the wing portions, so as to conform the sheet to a specific portion of the body. A soft pad of spongy material is adhered to one surface of the sheet to be placed against the body. A resilient protective coating completely covers the sheet and the soft pad, yet allows the sheet to bend and conform to the body portion. The entire unit is encased within a fabric material with straps permitting attachment of the protective pad to the body.

5 Claims, 3 Drawing Sheets

FLEXIBLE PROTECTIVE PADDING

TECHNICAL FIELD

The present invention relates generally to devices for protecting the body of an athlete, and more particularly to an improved protective pad which is flexible.

BACKGROUND OF THE INVENTION

The serious damage caused by hard blows frequently occurs to athletes in various contact sports, such as hockey and football. Despite the frequency and severity of such accidents, most technological progress in recent years has been in the area of post injury protective devices and various surgical procedures. Protective padding designed to prevent such injury are generally inadequate under severe circumstances.

The inventor has previously described an athletic knee protector in U.S. Pat. No. 4,685,153, which overcomes many of the problems in the field. However, that device was designed primarily for the knee, and suffered from some inflexibility.

It is therefore a general object of the present invention to provide an improved protective pad.

Another object of the present invention is to provide a protective pad which is both rigid, yet flexible for various applications.

These and other objects will become apparent from the following detailed description of the invention when considered in conjunction with the accompanying drawings.

SUMMARY OF THE INVENTION

The protective pad of the present invention includes a sheet of generally rigid malleable material having a plurality of spaced apart slots formed along at least a pair of opposing side edges, to form wing portions between the slots. The sheet is bent from end to end and from side to side to form a curve conforming to a portion of the body which is protected. The side edges of the sheet are shortened by overlapping the wing portions, so as to conform the sheet to this specific portion of the body. A soft pad of spongy material is adhered to one surface of the sheet to be placed against the body. A resilient protective coating completely covers the sheet and the soft pad, yet allows the sheet to bend and conform to the body portion. The entire unit is encased within a fabric material with straps permitting attachment of the protective pad to the body.

DESCRIPTION OF THE PREFERRED EMBODIMENTS

Figure 1:
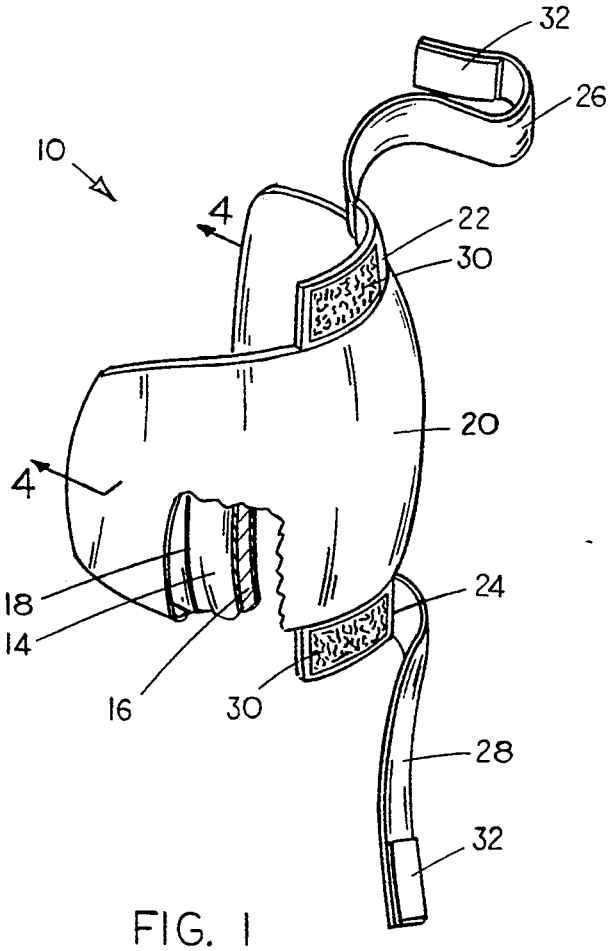
FIG. 1 is a perspective view of the invention with a portion thereof broken away to show interior elements.
Figure 2:
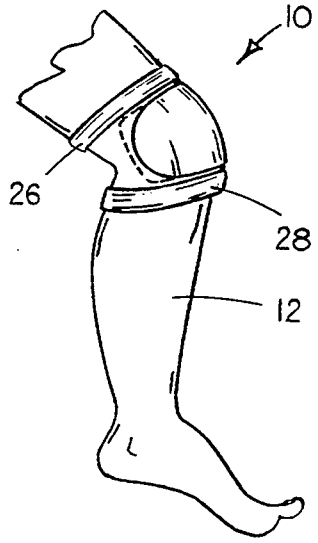
FIG. 2 is a side elevational view of the invention installed on a leg.

Referring now to the drawings, in which similar or corresponding parts are identified with the same reference numeral, and more particularly to FIGS. 1 and 2, the protective pad of the present invention is designated generally at 10 and is shown wrapped around a knee on a leg 12.

Figure 4:
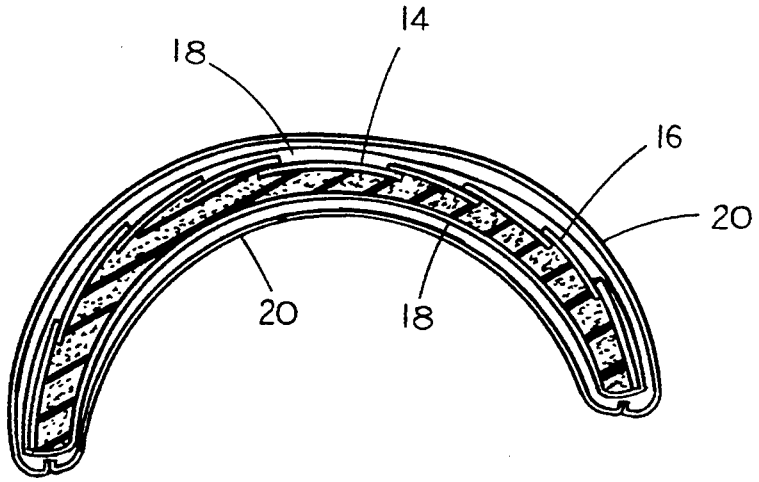
FIG. 4 is a sectional view taken at lines 4—4 in FIG. 1.

Referring now to FIGS. 1 and 4, protective padding 10 includes a generally rigid metal shield 14 which is affixed to the exterior surface of a sheet of high density closed cell foam material with an adhesive or the like. Shield 14 is preferably a sheet of aluminum having a thickness of approximately 0.32 inches, so as to permit manual manipulation of the shield 14 into the desired configuration. Once shield 14 and foam 16 have been manipulated to the desired configuration, the entire assembly is coated with 1/32 of an inch of neoprene 18, or a similar material.

The entire neoprene coated assembly is installed within a nylon cover 20. A pair of upper and lower wings 22 and 24 project from the upper and lower edges of nylon cover 20 and have one end of an elastic strap 26 and 28 respectively attached thereto. A sheet of hook material 30 is mounted on the exterior surface of wings 22 and 24 and will selectively attach to sheets of loop material 32 mounted on the free ends of strap 26 and 28. In this way, straps 26 and 28 may be secured around a leg 12 so as to secure pad 10 in position, as shown in FIG. 2.

Figure 3:
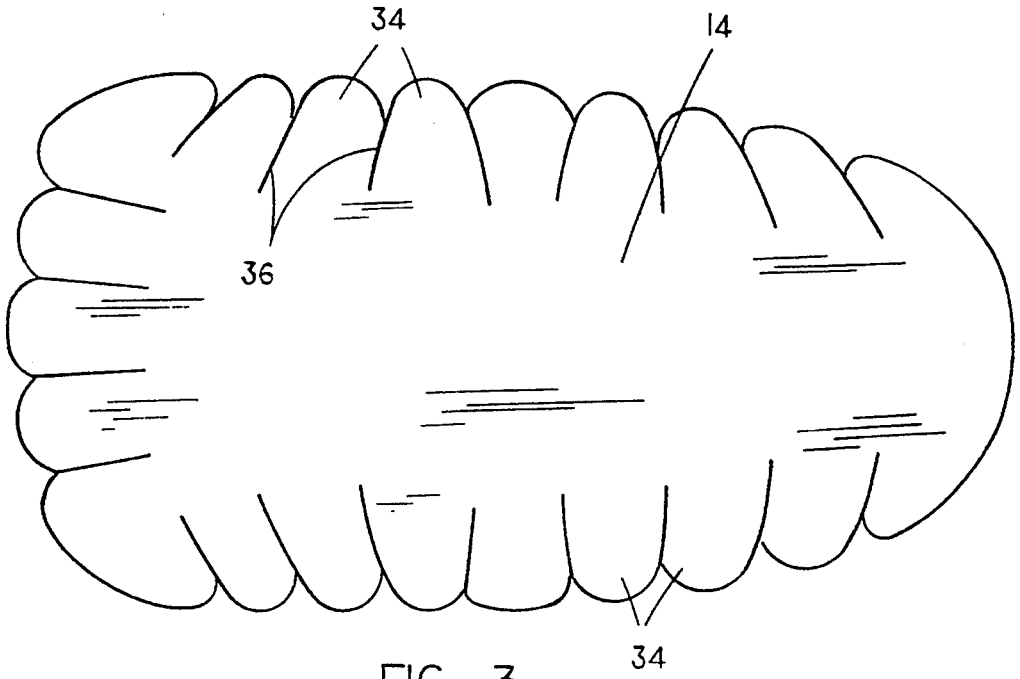
FIG. 3 is a plan view of a shield utilized in the invention.

In order to make the metal shield 14 more flexible to follow the curvature of the body member covered by pad 10, a series of wings 34 are formed in each edge of shield 14 by cutting slots 36 inwardly towards the center of shield 14. The ends of each wing 34 are rounded, such that wings 34 will overlap one another without projecting points, when shield 14 is bent into the desired configuration. Wings 34 permit curvature of shield 14 along the edges, to permit different curvatures along each various edge. The configuration of FIG. 3 is utilized for a knee pad. No wings are formed in the right hand edge of shield 14 since this portion of the shield will be adjacent the interior of the knee, where little curvature of the shield is needed.

Figure 5:
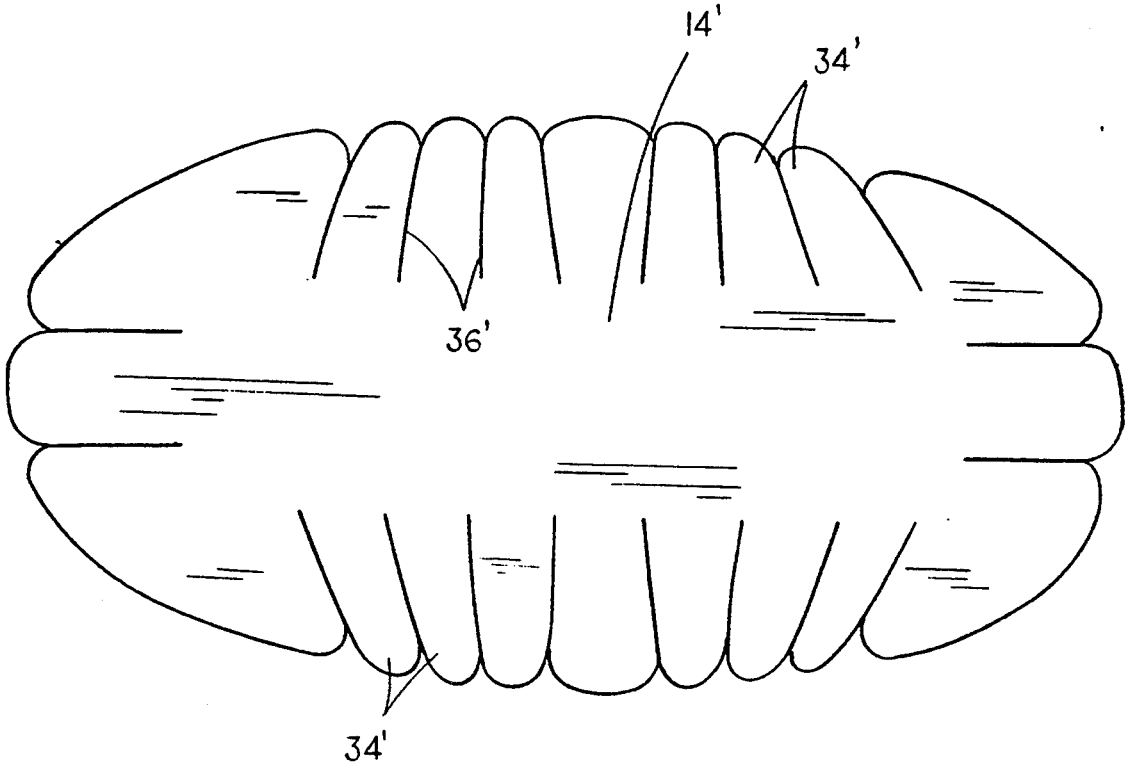
FIG. 5 is a plan view of a second embodiment of the invention.

FIG. 5 is a plan view of a shield 14' having wings 34' which is designed for use around the biceps, or similar body portion. It should be noted that slots 36' extend inwardly farther than the slots 36 of shield 14 in FIG. 3, because a greater curvature is desired along the longitudinal edges of shield 14'.

Figure 6:
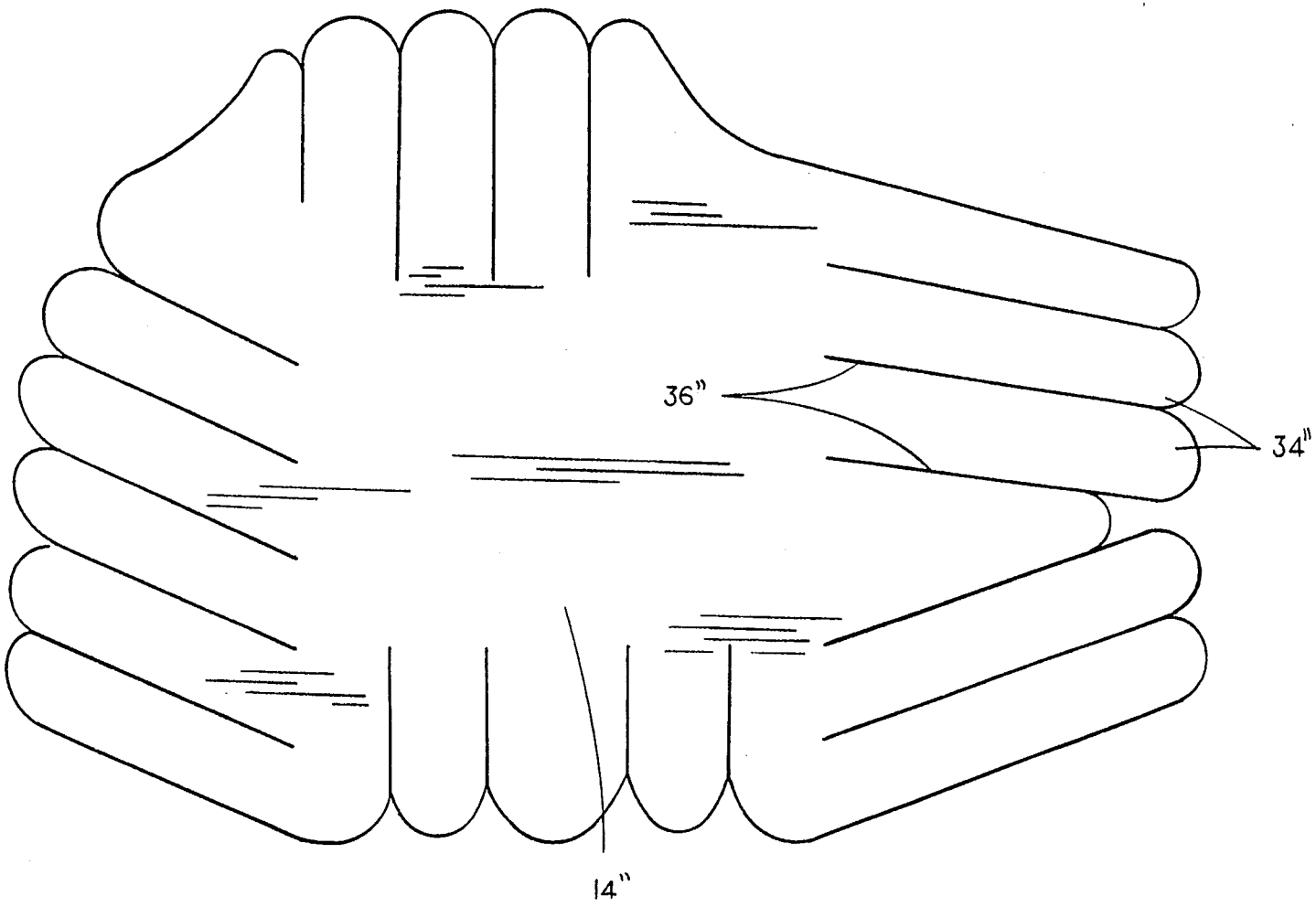
FIG. 6 is a plan view of a third embodiment of the invention.

FIG. 6 is yet another design for a shield 14'' which is configured for use along the thigh area. Again, extremely lengthy slots 36'' are utilized on those edges requiring the greatest curvature, thereby permitting wings 34'' to move the greatest distance.

Whereas the invention has been shown and described in connection with the preferred embodiments thereof, it will be understood that many modifications, substitutions and additions may be made which are within the intended broad scope of the appended claims. There has therefore been shown and described an improved athletic pad which accomplishes at least all of the above stated objects.

I claim:

1. A protective pad, comprising:

a sheet of generally rigid, malleable material having first and second opposing ends, first and second opposing side edges, and inner and outer surfaces;

said sheet having a plurality of spaced apart slots formed therethrough extending inwardly from said side edges and said ends, the portions of said sheet between each pair of slots forming wing portions;

wherein said sheet is gradually curved from side edge to side edge and from end to end;

wherein the wing portions along said side edges and ends are overlapped to permit a change in curvature along said side edges and ends;

said wing portions including side edges formed by said slots and a free end connecting said side edges, said free ends being rounded from side edge to side edge;

said sheet being completely encased within a fabric case; and means on said case for selectively attaching the protective pad to a portion of a body.

2. The protective pad of claim 1, further comprising a soft pad of spongy material adhered to the inner surface of sheet material within said case.

3. The protective pad of claim 2, further comprising a resilient protective coating completely covering said sheet and spongy material.

4. The protective pad of claim 3, wherein said coating is neoprene.

5. The protective pad of claim 1, wherein said sheet is formed from aluminum.

* * * * *